United States Patent [19]

Hagen

[11] 4,309,152

[45] Jan. 5, 1982

[54] HYDRAULIC MOTOR/PUMP WITH VARIABLE MECHANICAL ADVANTAGE

[75] Inventor: Glenn E. Hagen, New Orleans, La.

[73] Assignee: Sea Energy Corporation, New Orleans, La.

[21] Appl. No.: 72,987

[22] Filed: Sep. 6, 1979

[51] Int. Cl.[3] ..... F04B 1/06

[52] U.S. Cl. ..... 417/218; 417/399; 417/461

[58] Field of Search ..... 417/398, 399, 505, 461, 417/428, 221, 218, 390, 273; 91/497; 92/12.1, 12.2

[56] References Cited

U.S. PATENT DOCUMENTS

| | | | |
|---|---|---|---|
| 1,072,718 | 9/1913 | Heindl | 417/399 |
| 1,902,345 | 3/1933 | Valentine | 91/497 X |
| 2,755,966 | 7/1956 | Lindars | 91/275 X |
| 2,762,307 | 9/1956 | Orloff | 91/502 X |
| 3,972,268 | 8/1976 | Freeman | 91/497 X |
| 4,028,014 | 6/1977 | Cocks | 417/403 |
| 4,077,213 | 3/1978 | Hagen | 60/500 |

*Primary Examiner*—William L. Freeh
*Assistant Examiner*—Edward Look
*Attorney, Agent, or Firm*—Arthur M. Dula

[57] ABSTRACT

The invention is an efficient hydraulic motor/pump whose mechanical advantage can be varied while it is operating. Preferred embodiments described include a multi-cylinder reciprocation motor/pump, a variable level power extraction system used with a wave generator, a hydraulic transformer and a hydraulic autotransformer.

3 Claims, 11 Drawing Figures

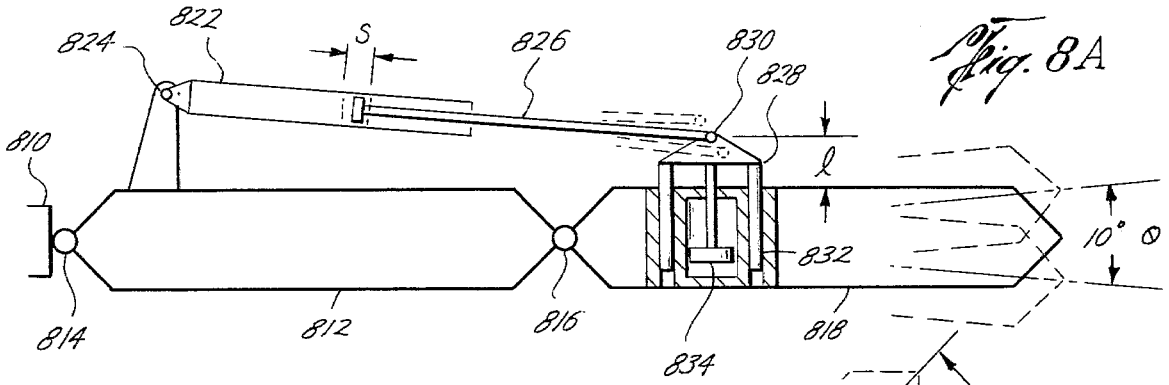
Fig. 8A
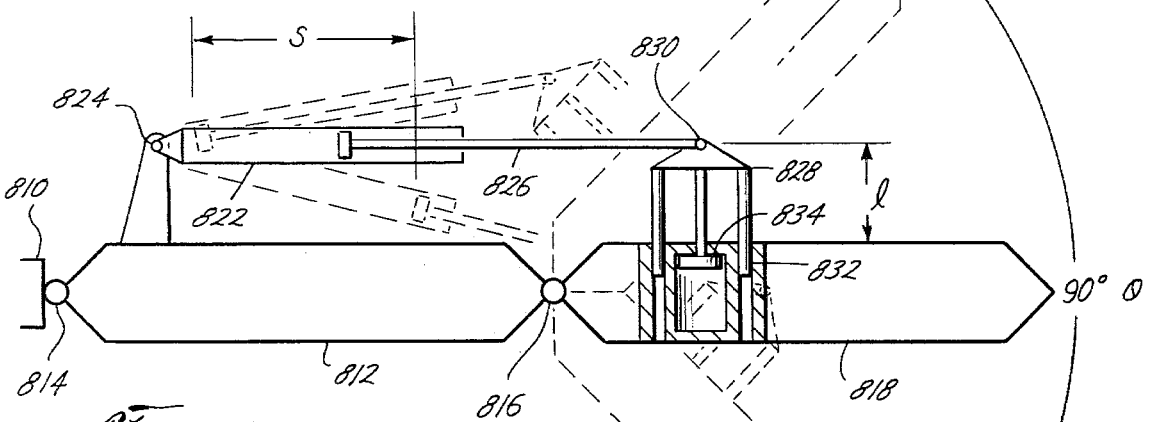
Fig. 8B
Fig. 9
| Θ° | (cm) STROKE (s) | (cm) LENGTH (ℓ) | AVERAGE HYDRAULIC POWER (KWH) |
|---|---|---|---|
| 10 | 5 | 57 | .12 |
| 10 | 10 | 114 | |
| 10 | 20 | 229 | |
| 45 | 50 | 128 | |
| 45 | 100 | 256 | |
| 45 | 150 | 384 | |
| 90 | 100 | 130 | |
| 90 | 200 | 261 | |
| 90 | 300 | 392 | 9.5 |

HYDRAULIC MOTOR/PUMP WITH VARIABLE MECHANICAL ADVANTAGE

BACKGROUND OF THE INVENTION

1. Field of the Invention

The present invention relates generally to hydraulic machinery and more specifically relates to hydraulic motor/pumps whose mechanical advantage can be varied during their operation.

2. Background of the Prior Art

Since the development of the water wheel and inclined screw pump in classical times, humanity has used hydraulic machinery to derive mechanical motion from flowing fluids and vice versa.

a. Specific Pumps

Hydraulic machines, for example the Pappenhein, Cochrane, Cary, Pattison, Ramelli, Emory, Heppel, Knott, Repsol, and/or Holly, rotary pumps use eccentric interlocking stators or gears to convert rotary mechanical energy into fluid pressure. The Quimby screw pump is illustrative of a class of hydraulic pumps that use screw threads in a cylinder to move viscous fluids. Other examples of higher pressure rotary pumps include those developed by Gould, Greindl, Mellory and Hasafan.

The above pumps generally have two mated gears or lobes closely fitting within a casing. One gear is the driver, the other gear, the follower, is driven by the driver. Many adaptations have been tried to obtain an efficient rotary pump.

The Gerotor pump uses an inner gear that is keyed to and rotates with, the driving shaft; an outer gear of internal type is driven by the inner gear and is free to rotate with a snug fit in a recess in one end of the housing. The teeth of the two gears are specially shaped so that the tops of all teeth of the inner gear are always in sliding contact with the teeth of the outer gear.

The Vickers vane pump is a constant discharge pump in which radial vanes produce the pumping action. The vanes are free to slide in and out of a rotating hub and so maintain contact with an outer ring. Oilways from the high pressure discharge of the pump to the spaces behind the vanes assure that this contact is maintained.

Unfortunately, rotary pumps are less efficient than piston pumps. Piston pumps include valve plate axial piston pumps, in which pistons are driven by a non-revolving wobble plate, and bent axis valve plate axial piston pump, wherein the angle between two sections of the pump housing, which may be adjusted by hand or servo control, determines piston travel.

The Hele-Shaw radial piston pump converts the rotary motion of an eccentric shaft into motion of pistons pumping fluid.

The centrifugal pump and its functional converse the turbine motor use centrifugal and reaction force, respectively, to accomplish their purposes.

b. General Discussion

Rotary Pumps are of the positive-displacement type, usually valveless, simple, compact, light in weight, and low in first cost. They are built in capacities from a fraction of a gallon (as in domestic oil burners and refrigerators) to 5,000 gpm and above, as in marine cargo service. Though used for pressure up to 1,000 psi, their particular field is for pressures of 25 to 500 psi. Before the development of the modern centrifugal pump, large rotary pumps of lobe type were used for low-head irrigation projects in capacities as large as 35,000 gpm and showed mechanical efficiencies of 80 to 85 percent.

Rotary pumps require the maintenance of very close clearances between rubbing surfaces for their continued volumetric efficiency. No satisfactory method of packing the moving surfaces to compensate for wear has been developed; consequently, although some rotary pumps are used successfully for clean water, their great field of application is in pumping oils or other liquids having lubricating value and sufficient viscosity to prevent excessive leakage. Rotary pumps are being used in the oil industry in increasing volume. They are also used for liquids of high viscosities.

Pigott (*Oil Gas Jour.*, May 10, 1934) classifies rotary pumps in the following seven groups: (1) vane type, (a) sliding vanes, (b) swinging vanes; (2) oscillating-piston or eccentric type; (3) gear type, (a) lobar, two and three teeth, (b) special-contours teeth, (c) spur gear, (d) helical and herringbone gear, (e) internal gear with two-teeth differences or with one-tooth difference; (4) screw type; (5) radial plunger type; (6) swash-plate type; and (7) miscellaneous.

Rotary pumps up to 100 psi may be considered low pressure, from 100 to 500 psi moderate pressure, and above 500 psi high pressure; fractional to 50 gpm are small-volume pumps, 50 to 500 gpm moderate-volume, and above 500 gpm large-volume.

Vane Pumps. Leakage in vane-type pumps occurs across the tips and sides of the vanes. Since the vane tips cannot be made to fit the bore of the housing in all positions, there is line contact and low resistance to leakage. Wear is serious at the higher speeds unless the vanes are restrained against centrifugal forces. Increasing the number of vanes materially decreases leakage, but increases cost and complexity.

Guided-vane Type Pumps. A single rotor revolves in a case. The pumping element consists of multiple blades sliding in and out of slots in the rotor. Impeller and case are eccentric. Centrifugal force or pressure maintains the outer end of the blades in contact with the casing bore. The blades are made of hardened steel, bronze, or bakelite. This type of pump is useful for small and moderate capacities and low pressure. Rapid wear on the points of the sliding blades and in the casing occurs where speed is high or where the liquid pumped has a low lubricating value. In some constructions, the blades are made with end trunnions operating in grooves in the side plate.

Swinging-vane Type Pumps. This type of pump has vanes that are hinged or articulated. The hinge joints are subjected to wear, and the comparatively small number of vanes or blades possible with this construction give a less satisfactory seal than do the multiple blades in the sliding-vane type. Swinging-vane pumps are used for moderate volume, for low pressure and vacuum, and for low speeds.

Eccentric-piston Pumps. Many pumps of this type are in service. The contact between the strap and the body approximates single-line contact. Leakage, therefore, becomes excessive as wear progresses. This type of pump is useful for small and medium capacities, low pressure, and limited speed.

Radial-plunger and Swash-plate Pumps. The rotation of the body carrying the plungers connects each plunger flow periodically to the suction port on the plunger's suction stroke and to the discharge port on its discharge stroke. These can be adapted for variable capacity by varying the eccentricity between the plunger-carrying body and the ring that drives the plungers; or by varying the angle between the drive shaft and the plunger-carrying body. The actual machines are complicated.

Lobar Pumps. Lobar pumps are suitable for medium and large capacities and low pressures. As in the oscillating-piston type, there is line contact between the impeller and the body, and leakage is excessive at higher pressures. The impellers are not self-actuating. Such pumps, therefore, must be built with external pilot gears capable of transmitting half the power utilized from the driving to the driven shaft.

Gear Pumps. These pumps are of the two-shaft type and cover a wide variety of constructions. They are used for practically all capacities and pressures. In many types, the impeller gears are self-actuating, requiring no pilot gears. The simplest form uses spur gears. The large number of teeth in contact with the casing minimizes leakages around the periphery. The utility of the straight spur-gear type is limited by trapping of liquid, which occurs on the discharge side at the point of gear intermesh, resulting in noisy operation and low mechanical efficiency, particularly at high rotative speed. Discharge pockets in the side plates may be provided to reduce the effects of trapping. Impellers in other pumps of this type are of single-helical or double-helical construction with angles from 15 to 30 degrees or more. With gears of single-helical type on higher pressure, considerable end thrust of the impeller gears on the pump side plates results. Either helical or herringbone gear construction largely eliminates the effects of trapping but introduces leakage losses between the teeth at the meshing point unless the teeth are cut without root clearance.

Internal-gear Pumps. "One-tooth difference." In pumps of this type, an impeller mounted eccentrically with the body actuates an internal gear rotating in the body or in bearings carried in the end plates. Flow is practically continuous and without reversals. High rotative speeds may be used. In such pumps, leakage occurs around the periphery of the ring gear, over the tips of the gear teeth at open mesh, and through the contact line at full mesh. This type is particularly adaptable for high pressures and high speeds, for oils with lubricating value and considerable viscosity.

"Two-teeth difference." In this construction an abutment on one side plate is used to fill the clearance between the external and internal gear. Such construction reduces leakage, but involves the use of an overhung internal gear that restricts the pump's application to small and medium capacity and pressure.

Screw Pumps. In this type of pump, a long single helical impeller of small diameter and special form actuates one or more idler impellers contained in a casing so as to displace the liquid pumped axially. Multiple surface, rather than line contacts, between screws and case minimizes leakage. This construction permits operation at very high speed. Where, right- and left-hand helices are used, the pumping load is balanced and thrust is eliminated. No shaft bearings or timing gears are required owing to the form of the impellers. Wear of rotating elements may be rapid with liquids of low lubricating value.

Double-screw Pumps. Double-screw pump construction incorporates right- and left-hand intermeshing helices on parallel shafts with timing gears. These pumps have been extensively used for medium and large capacities and moderate to high pressures. There is some leakage axially at the impeller contact. Impellers are carried in bearings so that wear on impellers and casing is reduced. Flow is practically continuous.

The mechanical efficiency of the better types of rotary pumps when handling oils or other liquids with lubricating value is good.

Aside from leakage, wear problems and strictly limited ranges of capacities and pressures, the conventional hydraulic pumps described above are generally not good hydraulic motors and vice versa.

A simple reciprocating piston connected to a flywheel doesn't leak, doesn't wear when pumping non-lubricating fluids and is both a good hydraulic pump and an efficient hydraulic motor. This arrangement's greatest defect is that its mechanical advantage is constant, or at least cannot be altered while in operation. The result of this limitation is that the speed and torque of such a motor is a function of fluid flow and pressure. Used as a pump, its delivery is a function of flywheel speed and its output pressure is a function of input torque for a given constant load.

In the past these limitations have been avoided by operating reciprocating machines at variable speeds, by bypassing some of the pumped fluid around the pump at constant speed, or by intermittently loading and unloading the pump. The size of the piston may also be changed, but not while the system is in operation. All of these expedients either require that the system be stopped or that it lose efficiency.

SUMMARY OF THE PRESENT INVENTION

The present invention is a hydraulic pump whose crankshaft is stationary while its cylinder or cylinders rotate. Since the crankshaft is stationary, its connecting rods' length and thus the mechanical advantage of the system, can be varied while the invention is in operation. This change in mechanical advantage creates a variable hydraulic gear box. Connecting two such gear boxes together produces a hydraulic equivalent of a variable transformer. The addition of servo-control produces a hydraulic autotransformer. The invention may also be used to construct a high efficiency, variable power absorber for a wave generator.

BRIEF DESCRIPTION OF THE DRAWINGS

FIG. 8A shows another embodiment of the present invention configured as a variable power absorber on a wave generating system during low (10 degree) sea states;

FIG. 8B shows the same embodiment of the present invention as is shown in FIG. 8A except that the invention is now adapted to absorb power from 90 degree sea states;

FIG. 9 is a table detailing the sea state "$\theta$", length "l", stroke "s", and amount of hydraulic power generated by the embodiment of the present invention shown in FIGS. 8A and 8B.

INDEX LIST TO DRAWINGS

Figure 1:
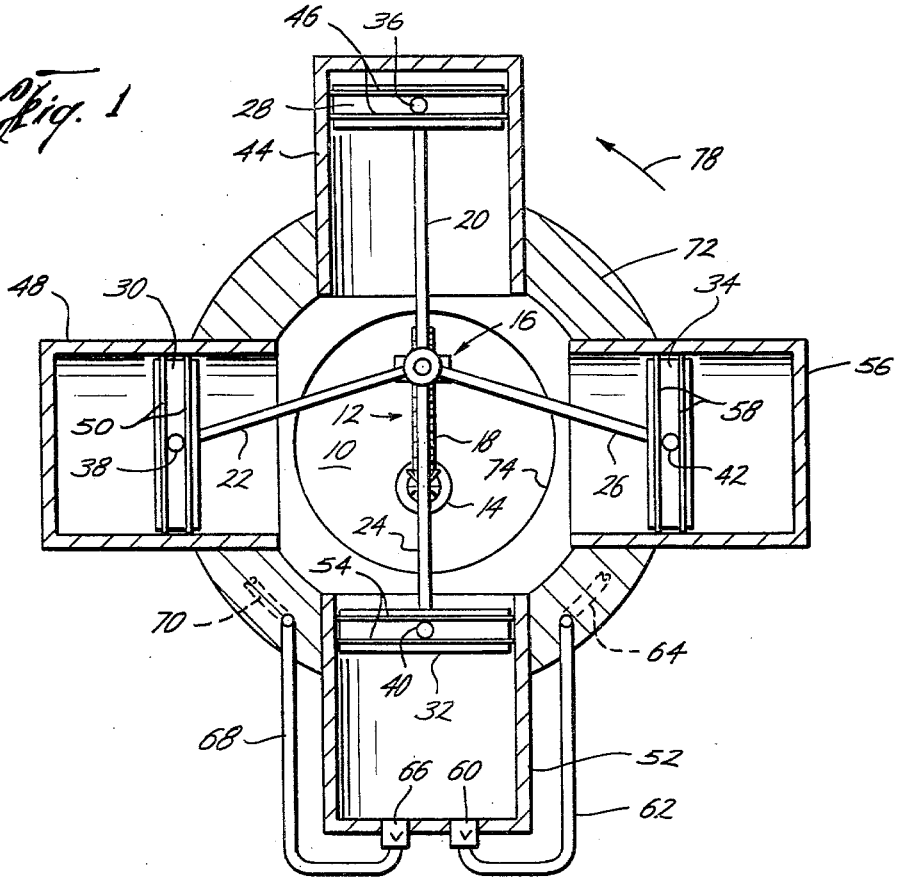
FIG. 1 is a partially cutaway schematic view of a four-cylinder hydraulic motor/pump constructed according to the preferred embodiment of the present invention.

10 Crankshaft block
12 Crankshaft unit
14 Motor
16 Crankshaft
18 Screw thread
20 Connecting rods
22 Connecting rods
24 Connecting rods
26 Connecting rods
28 Pistons
30 Pistons
32 Pistons
34 Pistons
36 Wrist pins
38 Wrist pins
40 Wrist pins
42 Wrist pins
44 Cylinder
46 Sealing ring
48 Cylinder
50 Sealing ring
52 Cylinder
54 Sealing ring
56 Cylinder
58 Seal ring
60 Valve (inlet)
62 Hydraulic pipe
64 Fluid manifold
66 Outlet valve
68 Outlet tube
70 Outlet manifold
72 Cylinder block
74 Bearing surface
78 Arrow
210 Base plate
212 Upright
214 Bolts
216 End
218 Crankshaft block
220 Bolts
222 Cavity
224 Offset crankshaft
226 Motor
228 Screw threads
230 Screw threads
232 Bearing
234 Crankshaft
236 Connecting rod
238 Bearing end
240 Upper end
242 Piston
244 Cylinder
246 Seal ring
248 Inlet valve
250 Inlet manifold
252 Outlet valve
254 Output manifold
256 Hydraulic line
258 Inlet adapter
260 Connecting rod
262 End
264 Piston
266 Cylinder
268 Annular ring
270 Inlet valve
272 Outlet valve
274 Hydraulic line
276 Shaft adapter
278 Bearing post
280 Bearing blocks
282 Bearing surfaces
284 Drive shaft
286 End
288 Hub assembly
290 Bolt
292 Bolt
294 Carrier shaft
296 Hydraulic passageway
298 Hydraulic coupler
300 Inlet supply pipe
302 Hydraulic passage
304 Coupler
306 Hydraulic line
308 Coupler support
310 Bolt
312 Annular bearing
314 Bottom
316 Outer edge
318 Thrust bearing
320 Support structure
322 Bearing block
324 Outer portion
325 Control lever
326 Controller
328 Line
330 External housing
332 Bolts
334 Bolts
410 Upper bearing
412 Lower bearing
414 Upper bearing
416 Lower bearing
418 Shaft
420 Spur gear (vertical)(rear)
422 Horizontal spur gear (rear)
424 Shaft
426 Shaft
428 Frontal horizontal spur gear
430 Frontal vertical spur gear
432 Shaft
434 Threaded opening
436 Bearing opening
438 Threaded opening
502 Opening
504 Interior
506 Bearing surface
602 Partitions
604 Partitions
710 Hydraulic motor
712 Shaft
714 Drive pump
716 Control assembly 718 Control assembly
720 Input-output pair
722 Coupling
724 Input-output pair
810 Fixed point
812 Float
814 Hinge
816 Hinge
818 Float
822 Cylinder
824 Hinge
826 Shaft
828 Support
830 Hinge
832 Bearing
834 Cylinder
1002 Fixed mounting
1004 Pivot mount
1006 Pivot mount
1008 Pivot flange
1010 Cylinder
1012 Bearing
1014 Flange
1016 Cylinder
1018 Bearing
1020 Water source line
1022 Valve
1024 Valve
1026 Forward portion
1028 Rear space
1030 Piston
1032 Seal ring
1034 Wrist pin
1036 Pump shaft
1038 Valve
1040 Output line
1042 Valve
1044 Magnetized portion
1046 Magnetized region
1048 Switch
1050 Control line
1052 Control logic
1054 Bearing
1055 End
1056 Rocker arm
1058 End
1060 Bearing
1062 Motor arm
1064 Magnetized region
1066 Limit switch
1068 Piston
1070 Magnetized region
1072 Sealing ring
1074 Forward portion
1076 Line
1078 Valve
1080 Rear interior portion
1082 Hydraulic line
1084 Line
1086 Line
1088 Line
1090 Line
1092 Mounting surface
1094 Mount
1096 Weld
1098 Mounting means
1100 Weld
1102 Bearing surface
1104 Upper end
1106 Lower end
1108 Fulcrum assembly
1110 Bearing
1112 Motor
1114 Worm gear
1116 Idler gear
1118 Geared portion
1120 Control line
1122 Motor controller
1124 Control lever
1126 Fulcrum assembly
1128 Bearing
1130 Bearing

DESCRIPTION OF THE PREFERRED EMBODIMENT

FIG. 1 shows a schematic cross-sectional view of a hydraulic motor/pump constructed according to the preferred embodiment of the present invention.

Stationary crankshaft block 10 includes variable crankshaft unit 12, which is a screw thread 18 engaging motor 14. Movable crankshaft 16 moveably engages elongated threaded member 18.

Crankshaft 16 comes out of the plane of FIG. 1 and rotatingly engages connecting rods 20, 22, 24, and 26 by means of conventional crankshaft bearings.

Connecting rods 20, 22, 24, and 26 are connected at their terminal ends to pistons 28, 30, 32, and 34, respectively, through wrist pins 36, 38, 40, and 42, respectively.

Piston 28 is movably disposed within cylinder 44. Piston 28 is held in sealing contact with the interior of cylinder 44 by means of annular sealing rings 46. Piston 30 is movably disposed within cylinder 48 and is in sealing contact with the interior of cylinder 48 by means of annular seal rings 50. Piston 32 is movably disposed within cylinder 52. The outer perimeter of piston 32 is held in sealing contact with the interior of cylinder 52 by means of annular seal rings 54. Piston 34 is movably disposed within cylinder 56. The outer perimeter of piston 34 is held in sealing contact with the interior of cylinder 56 by means of annular seal rings 58.

Referring now to cylinder 52 in FIG. 1, inlet valve 60 is in fluid connection with the interior of cylinder 52 and, by means of hydraulic pipe 62, is in fluid communication with inlet fluid manifold 64. Outlet valve 66 is similarly disposed by means of outlet tube 68 between outlet manifold 70 and the interior of cylinder 52.

It should be understood that FIG. 1 is included in this specification to teach how to make and use the present invention. The pistons and cylinders described above may be made of any material sufficiently strong to withstand the pressure generated by the invention when it is being used as a pump or motor, i.e., between 50 psi and 14,000 psi. The inlet and outlet valves described in connection with cylinder 52 are self-actuating check valves when the present invention is operating as a pump, but will require external means of mechanical or electrical actuation when the present device is operating as a motor. These valve actuating means, which may be either mechanical, hydraulic or electrical, are well known to those skilled in the art of mechanical and hydraulic engineering. Thus, purely as a convenience and for simplicity, these actuation means will not be described in detail, but discussion will be had as if such actuation means were present.

Cylinders 44, 48, 52, and 56 are mechanically fixed within a cylinder block 72. This cylinder block is shown in FIG. 1 as being a circular metal casting adapted to receive the cylinders much as the block of some foreign automobiles, i.e., Renault, receives cylinder inserts. It should be understood that this cylinder block 72 can be any means for holding the cylinders in position and also provides a bearing surface 74 along its inner perimeter disposed so as to make sliding contact with the outer bearing surface of crankshaft block assembly 10.

The cylinders and pistons of this invention rotate, thus good engineering practice will dispose the cylinders such that the center of mass of the cylinders and block 72, taken together as a rotor or cylinder assembly, will be as close as possible to the assembly's center of rotation.

Bearing 74 and the wrist pins and crankshaft bearings used by the preferred embodiment of the present invention must be lubricated to function properly. Lubrication systems required to pump oil or other lubricating fluids to such bearings are well known to those skilled in the art of hydraulic or automotive engineering. Thus the oiling systems that are a necessary part of the present invention are not shown because their design and manufacture would be obvious to anyone of ordinary skill in the art to which this invention pertains.

The materials used to construct the crankshaft and connecting rods of the present invention must be strong enough not to break and rigid enough not to deform under the loads imposed on them when the present invention is operating as either a motor or a pump.

Functionally, cylinder block assembly 72 and cylinders 44, 48, 52 and 56 rotate on bearing 74 around stationary crankshaft block assembly 10. In FIG. 1 crankshaft 16 is shown positioned approximately three-quarters of the way up threaded member 18.

Because crankshaft 16 is offset from the center of rotation of block 72, rotating block assembly 72 on bearing surface 74 in the direction indicated by arrow 78 causes pistons 28 to move inward toward block 10 in cylinder 44, while piston 32 moves outward in cylinder 52. Given the indicated rotational direction 78 of block 72, piston 34 moves toward the top of cylinder 56 while piston 30 moves toward the bottom of cylinder 48.

As piston 32 moves toward the top of cylinder 52 the hydraulic fluid within cylinder 52 is forced through outlet valve 66 and outlet tube 68 into outlet manifold 70. From outlet manifold 70, as will be shown in greater detail in FIG. 2 below, the pumped fluid is carried out of the pump. Simultaneously, the downward movement of piston 28 in cylinder 44 draws hydraulic fluid in through its associated inlet valve from the inlet manifold.

For the purpose of simplicity, only one set of inlet and outlet valves, those associated with cylinder 52, is shown. It should be understood that each cylinder in the present invention is equipped with such valves.

To vary the mechanical advantage of the present invention, prime mover 14 rotates screw thread 18. This rotation moves crankshaft assembly 16 toward or away from the center of rotation of crankshaft block 10 depending on the screw thread's direction of rotation. If crankshaft 16 is moved toward the center of rotation of crankshaft block 10, then the stroke of the pistons in the present invention in their respective cylinders becomes shorter by a factor of 2 k, where k is the change in distance between the center of shaft 16 and the center of rotation of block 10, while the pressure exerted on the hydraulic fluid by the piston becomes proportionately greater for a constant load. In all the examples citing specific flow rates and pressures in this application, a constant load is assumed. The effect of higher flow rates on hydrodynamic drag is also ignored. In reality hydrodynamic drag goes up as power function of flow rate. As the examples given in the present specification are illustrative, those skilled in the art will clearly understand them despite these simplifications.

In the limiting case, when the crankshaft assembly 16 has been lowered on screw thread 18 until its center coincides with the center of rotation of crankshaft block assembly 10, then all of the pistons sit stationary in their respective cylinders. In this condition the present invention is totally unloaded and the only work done by the present invention would be that work required to overcome the frictional losses associated with bearing 74 and the connecting rod bearings on crankshaft assembly 16.

At the other extreme, when prime mover 14 has rotated screw thread member 18 so as to move crankshaft assembly 16 to the upper limit of travel on screw 18, then pistons 28, 30, 32 and 34 travel their maximum stroke, i.e., virtually the entire length of their respective cylinders. This causes the present invention to output a maximum flow of pumped fluid at minimum pressure for a given speed and torque of cylinder block assembly 72.

By varying the mechanical advantage of the present invention, any given rotational speed and torque input can selectably result in output flow rates and pressures that may be adjusted from a small flow rate at a high pressure to a high flow rate at a low pressure. Thus the present invention can replace all the prior art pumps discussed above while operating at higher efficiency and lower wear factors even when pumping non-lubricating fluids. The use of many cylinders can make output flow continuous.

The mechanical power put into the present invention when it operates as a pump is always equal to the hydraulic power, i.e., flow rate times the pressure, output from the invention, less frictional losses.

Within the envelope of possible pressures and flow rates dictated by the mechanical size of the pistons and the amount of offset from center of rotation to which the crankshaft of the present invention can be extended, the invention can continuously vary the flow rate and pressure to always equal the same hydraulic power.

Figure 2:
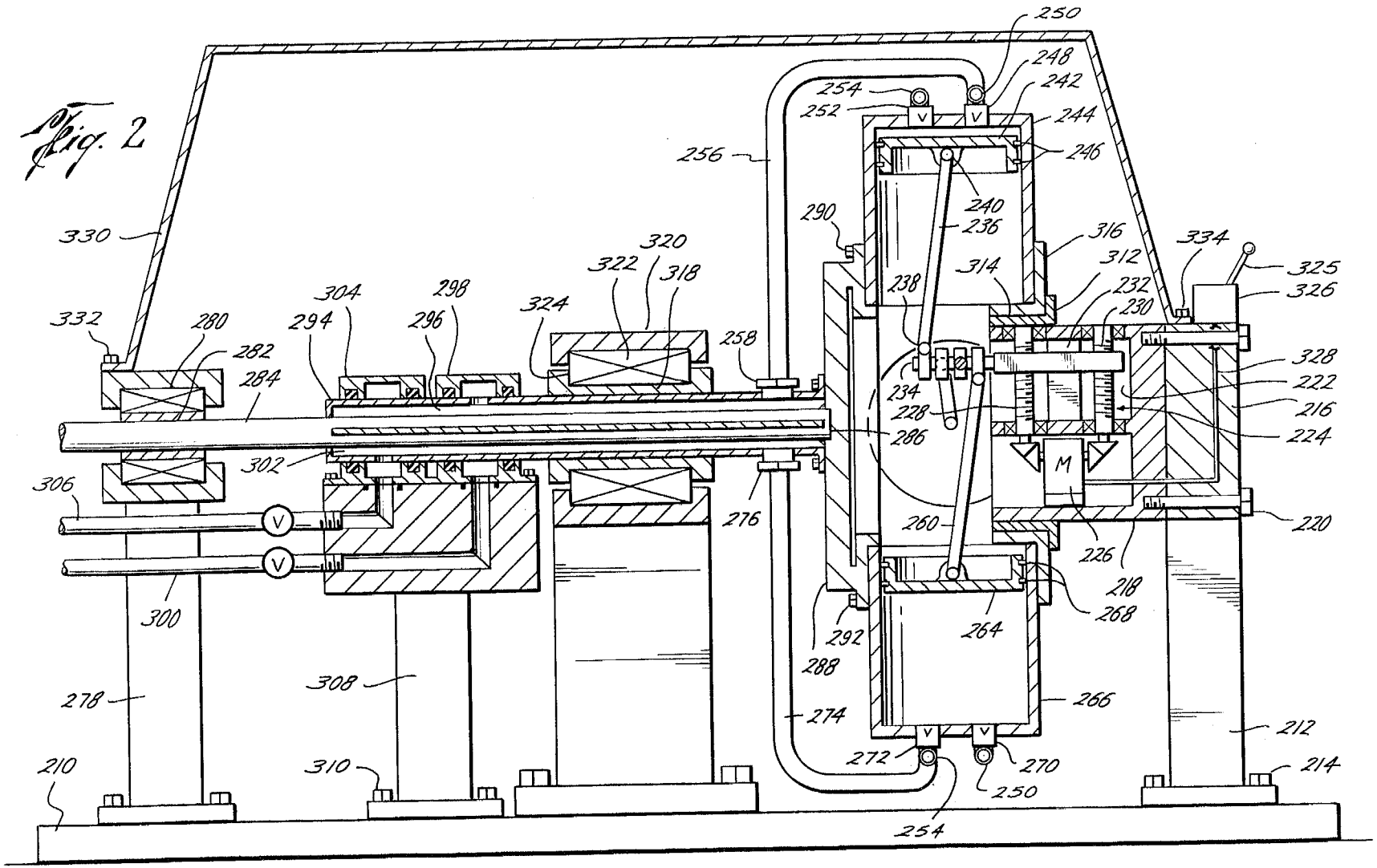
FIG. 2 is a cutaway side view of a motor/pump constructed according to the preferred embodiment of the present invention.

FIG. 2 shows a longitudinal cross-section of a motor/pump constructed according to the preferred embodiment of the present invention.

Base plate 210 has a first upright 212 affixed to it by bolts 214, by welding or any other convenient means. Upright 212 has connected to its upper end 216 a crankshaft block assembly 218, which is secured to upper end 216 of upright 212 by bolts 220, by welding or any other convenient means.

The end of crankshaft block assembly 218 opposite upper end 216 of upright 212 has a cavity 222 that contains variable offset crankshaft assembly 224.

Crankshaft assembly 224 includes a motor 226 that is adapted to drive a pair of screw threads 228 and 230. Between screw threads 228 and 230 is a rectangular bearing 232. In FIG. 2, crankshaft 234 is shown approximately three-quarters of the way up screw threads 228, 230 and bearing 232. Crankshaft assembly 224 is described in greater detail in the discussion describing FIG. 3 below.

Connecting rod 236 is connected at its lower connecting rod bearing end 238 to crankshaft 234 and at its upper end 240, by a wrist pin not shown, to piston 242. Piston 242 is held in slidably sealing contact with the interior of cylinder assembly 244 by annular seal rings 246.

At the top of cylinder assembly 244, inlet valve 248, which is a check valve adapted to let fluid into the cylinder, but not out of it, is in fluid communication with the interior of cylinder 244 and with inlet manifold 250.

Similarly outlet valve 252 is in controlled fluid communication with the interior of cylinder 244 and is also in fluid communication with output manifold 254. Outlet valve 252 is a check valve adapted to allow fluids to flow out of cylinder 244, but not into it. Inlet manifold 250 is in fluid communication by hydraulic line 256 to shaft inlet adapter 258.

Similarly, connecting rod 260 is connected at its crankshaft end 262 by a crankshaft bearing to crankshaft assembly 234 and at its piston end by a wrist pin, not shown, to piston 264. Piston 264 is maintained in sealing contact around its outer perimeter with the interior of cylinder assembly 266 by means of annular rings 268.

Inlet valve 270 controllably connects the interior of cylinder assembly 266 with inlet manifold 250, which is an annular manifold running around the outer perimeter of the cylinder on this embodiment of the present invention. Similarly, output valve 272 is in fluid communication with the interior of cylinder assembly 266 and is in fluid communication with outlet manifold 254.

Outlet manifold 254 is in fluid communication by hydraulic line 274 with hydraulic shaft adapter 276.

Bearing post 278 supports bearing blocks 280. Bearing surfaces 282 are in contact with drive shaft 284. It should be understood that all the bearings in the present invention have associated lubrication means which are not shown because they are well known to those skilled in the art of hydraulic and mechanical engineering.

Steel shaft 284 is affixed by welding or any other convenient means at its end 286 to hub assembly 288. Hub assembly 288 is connected by bolts 290 or any other convenient means to the exterior of cylinder assembly 244 and by bolts 292 to the exterior of cylinder assembly 266.

An annular hydraulic carrier shaft 294 surrounds steel shaft 284. This shaft defines two hemi-cylindrical fluid passageways. Details of this shaft are given in FIGS. 5 and 6 and the related text below.

Hydraulic connector 258 is in fluid communication with hydraulic passageway 296, which, in turn, is in fluid communication with hydraulic coupler 298. Hydraulic coupler 298 is in fluid communication with inlet supply pipe 300, which is connected to a hydraulic source not shown.

When the present invention is operated as a pump, line 300 is connected to a hydraulic sump. When the present invention is operated as a hydraulic motor, line 300 is connected to a hydraulic pressure source.

Fitting 276 places hydraulic line 274 in fluid communication with hydraulic passage 302, which, in turn, is in fluid communication with coupler 304 and hydraulic line 306. When line 300 is connected to a sump, line 306 is connected to a source and vice versa.

Hydraulic couplers 304, 298 are held by bolts, welding or any other convenient means on hydraulic couplers support 308, which is attached by bolts 310, by welding or any other convenient means, to base plate 210.

Bearing support stand 278 is also connected by bolts or other convenient means as shown to base 210.

Annular bearing 312 is affixed by any convenient means to the outer perimeter of crankshaft block assembly 218 on its side opposite upper end 216 of upright support 212. Bearing 312 is preferably an annular bearing that engages both the bottom 314 and the outer edge 316 of the carrier block of the cylinder assembly of the present invention.

Annular thrust bearing 318 is affixed by any convenient means to the outer perimeter of hydraulic supply shaft 294 where said shaft passes through bearing support structure 320, which contains bearing blocks 322. Thrust bearing 318 is adapted to act as a bearing along that portion of shaft 294 that is within bearing block assembly 322 and on the outer portions 324 of bearing block assembly 322. The purpose of this thrust bearing is to prevent lateral motion of the rotor assembly of the present invention.

When the present invention operates as a pump, torque is applied to driveshaft 284 from a prime mover, not shown. Torque is imparted through assembly 288 to rotate the piston assembly of the present invention around stationary crankshaft block 218. This rotation occurs on bearings 312, 318 and 282. Note that, in the preferred embodiment of the present invention shown in FIG. 2, bearing 318 keeps the rotatary assembly from moving to the right or left, i.e., laterally, while bearings 312 and 282 take the weight of the rotating portion of the invention.

When the embodiment of the present invention shown in FIG. 2 operates as a pump, fluid flows from a sump through fluid supply line 300, annular fluid coupling 298, and fluid passageway 296, fitting 258 and supply line 256 to inlet manifold 250. As the cylinder assembly rotates, hydraulic fluid is drawn through the inlet valves of the respective cylinders during their downward stroke and forced through the output valve of the respective cylinders during their downward stroke. As was discussed in connection with FIG. 1, above, for a given amount of input power, the delivery of output hydraulic power may be varied in pressure and flow rate, these two variables always being inverse to one another, by adjusting the degree of offset of crankshaft assembly 234 from the center of rotation of the cylinder assembly of the present invention.

Once hydraulic fluid is forced out through the outlet valves of the respective cylinders into the outlet manifold, it flows through manifold 254, outlet line 274, coupling 276, output annular passageway 302 and fluidic coupling 304 to output line 306.

Control 325 controls the flow of electric power from controller 326 through line 328 to motor 226. Motor 226 is a reversible electric motor capable of driving screw thread assemblies 228 and 230 in either direction and thus raising or lowering crankshaft assembly 234. This controller may be fluidic, electrical or mechanical. A simple hand wheel could be connected through a flexible shaft or gearing arrangement to raise or lower crankshaft 234. Alternatively, pressure sensors could be placed in the input line and/or torque sensors could be placed on the input drive shaft and negative feedback servo-control of the position of crankshaft 234 could be utilized to maintain a constant output pressure or flow rate in the face of variable torque and rotational speed to the input shaft.

Protective external housing 330 is connected by bolts 332 to the top of bearing stand 278 and by bolts 334 to the top of vertical posts 212. The purpose of this external housing is to comply with various OSHA and NIOSH standards for the protection of workers from rotating machinery. It completely encloses all moving parts of the present invention.

Pump Example

Pistons 242 and 264 have a diameter of 10 inches, i.e., an area of 78.5 square inches, and crankshaft adjusting mechanism 224 can adjust the length of the stroke of these pistons from zero inches to 24 inches. Given these parameters, if shaft 284 is driven at 100 rpm at a torque sufficient to produce 100 psia hydraulic pressure output when crankshaft assembly 234 is adjusted so as to produce a stroke of 24 inches, then the four-cylinder pump described in FIGS. 1 and 2 will discharge 3,264 gallons per minute at 100 psia pressure. If crankshaft adjusting mechanism 224 moves crankshaft 234 so that its center lies only 3 inches from the center of rotation of the cylinder assembly in the present invention, then the total stroke of the pistons of the preferred embodiment of the present invention is reduced to six inches and the embodiment of the present invention shown in FIGS. 1 and 2 will pump 136 gallons per minute at 2400 psia.

At this point, it is important to note that reciprocating hydraulic pistons and cylinders are an inherently efficient way to move fluids. They do not leak to any measurable degree and can achieve efficiencies in excess of 90 percent. It should also be noted that, no single prior art pump known to the inventor is capable of producing output volume and pressure ranges as great as the present invention. Normally a rotary impeller or centrifugal pump would be used to pump 3,264 gallons per minute at 100 psia while a reciprocating pump would be required to produce 136 gallons per minute at 2400 psia. Further, it would be virtually impossible to drive these two pumps from the same prime mover, i.e., with the same input speed and torque.

Figure 3:
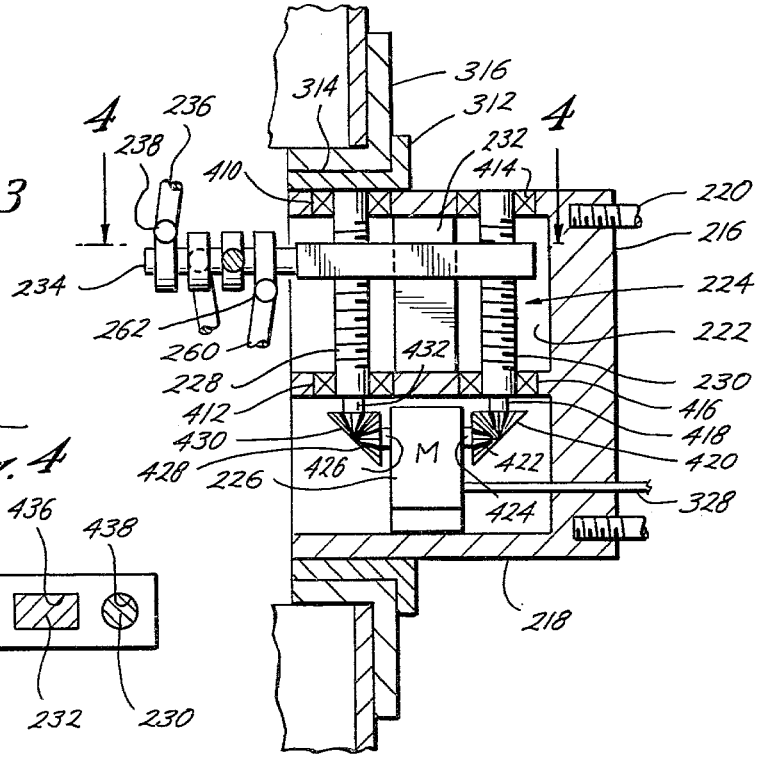
FIG. 3 is a detailed cross-sectional view of the variable length crankshaft unit in FIG. 2.

FIG. 3 shows crankshaft adjusting mechanism 224 in detail. In this Figure, similar numbers indicate similar structures to those in FIG. 2.

Bearing 312 is attached to block 218 and engages the bottom and a portion of the outer surface of cylinder block assembly 244.

Outer screw 228 engages an upper bearing 410 and a lower bearing 412. Rear screw threaded member 230 engages an upper bearing 414 and a lower bearing 416. Shaft 418 connects threaded member 230 to rear vertical spur gear 420, which, in turn, is connected through rear horizontal spur gear 422 to shaft 424 of reversible motor 226. The other output of reversible motor 226 is connected through shaft 426 and frontal horizontal spur gear 428 to frontal vertical spur gear 430. Frontal vertical gear 430 is connected through vertical shaft 432 to screw threaded member 228.

Crankshaft 234 is equipped with four bearing surfaces such as the one surrounded by crankshaft bearing 262 of connecting rod 260. Crankshaft assembly 234 is connected to a sliding bearing assembly having a first threaded opening 434 that engages screw thread 228, a middle power bearing opening 436 that engages bearing member 232 in slidably close contact, and a rear screw threaded opening 438 that engages rear screw threaded member 230.

For the purpose of the present invention threads 228, 230 taken together with bearing block 232 forms a lever arm whose fulcrum is in the center of offset crankshaft assembly 224. This center coincides with the center of rotation of structure 224. The center of structure 224 is referred to as the center of rotation because the cylinder assemblies of the present invention rotate about it. It is recognized that the crankshaft assembly is stationary. For convenience the center portion of crankshaft assembly 224 is referred to as a fulcrum for the purpose of this application. As offset crankshaft 234 comes close to this fulcrum, less reaction force is transmitted through the lever arm to block 218. As crankshaft 234 moves away from this fulcrum, then the reaction force impressed by the lever arm made up of screws 228, 230 and bearing 232 impress more reaction force on block 218. Motor 226 is the adjustment means for altering the distance between the point at which the lever arm formed by screw threads 228, 230 and bearing block 232 engages connecting rod 234 and the lever arm's fulcrum as heretofore described as the center of rotation of assembly 224.

Functionally, electric current from control line 328 causes motor 226 to rotate spur gears 428 and 422. The rotation of spur gears 428 and 422 causes the rotation of spur gears 430 and 420 and thus causes the rotation of threaded members 228 and 230, respectively. Threaded members 228 and 230 engage matingly threaded openings 434 and 438 attached to crankshaft 234 and, depending on the direction of their rotation, drive crankshaft 234 toward and away from motor 226. Movement of crankshaft 234 varies the mechanical advantage of the present invention.

Screw threads 228 and 230 move crankshaft 234 up and down. Bearings 436 and 232 withstand the mechanical stress imposed by the crankshaft by the moving cylinders.

Figure 4:
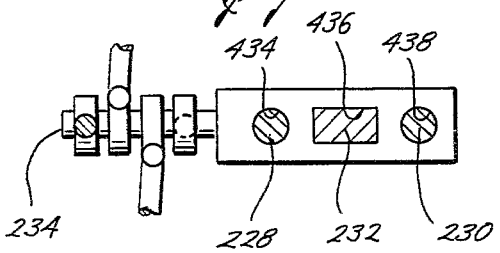
FIG. 4 is a view taken along lines 4—4 of FIG. 3.

FIG. 4 is a view of FIG. 3 taken along section lines 4—4. FIG. 4 shows a cross-sectional view of the portion of crankshaft assembly 234 that interacts with threaded members 228 and 230 and bearing structure 232. In FIG. 4, similar numbers indicate similar structures to those used in FIGS. 2 and 3.

Figure 5:
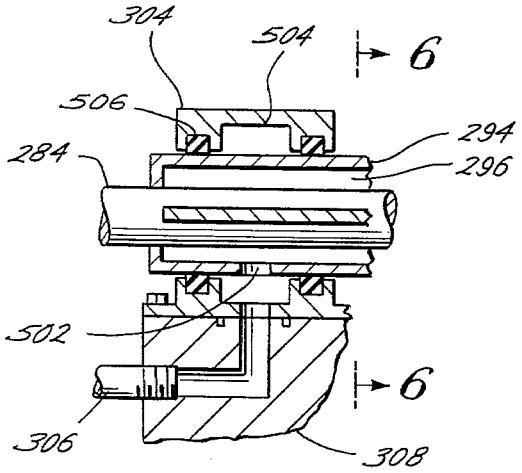
FIG. 5 is a detail of the fluid coupling utilized by the preferred embodiment of the present invention shown in FIG. 2.

FIG. 5 shows a detail of the hydraulic coupling between hydraulic conduit shaft 294 and annular hydraulic fluid coupling means 304. Similar numbers indicate similar structures to FIG. 2.

In FIG. 5 a solid steel drive shaft 284 is positioned annularly internal to two hemi-cylindrical fluid passageways, one of which is designated 296. The entire structure, i.e., two hemi-cylindrical shafts and the steel shaft, are referred to as conduit structure 294. The portion of shaft 294 engaging annularly hydraulic coupling 304 is equipped with an opening 502 that places the interior 504 of hydraulic coupling 304 in fluid communication with hemi-cylindrical conduit 302. As this opening rotates with the piston assembly of the present invention, it always stays within annular fluid cavity 504.

Hydraulic coupling 304 is equipped with bearing surfaces 506 that annularly surround conduit means 294 to produce an annular fluid-tight seal about chamber 504.

Fluid coupling 304 is connected by welding, bolting or any other convenient means to fluid support posts 308. Annular fluid channel 504 is in fluid communication with supply line 306.

Many ways of coupling stationary hydraulic supplies or sumps to rotating hydraulic machinery are well known to those skilled in the art of hydraulic engineering. The present embodiment is shown as a convenience only and is not intended to be limiting.

Figure 6:
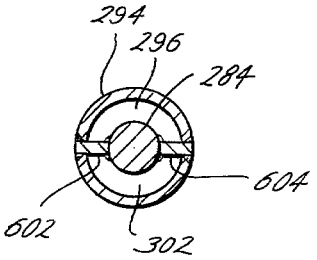
FIG. 6 is a view taken along section lines 6—6 of FIG. 5.

FIG. 6 is a view taken along section lines 6—6 of FIG. 5. The purpose of FIG. 6 is to indicate the construction of the hemi-cylindrical fluid passages used in the preferred embodiment of the present invention.

In FIG. 6 a central drive shaft 284 is surrounded by conduit shell 294. Partitions 602 and 604 divide the annulus between outer shell 294 and inner core 284 in two hemi-cylindrical passageways, one of which is hemi-cylindrical passageway 296 discussed in connection with FIG. 5, above, while the other is hemi-cylindrical passageway 302 described in connection with FIG. 2, above.

These shafts, passageways and dividers may be made of any convenient material capable of withstanding the hydraulic pressure utilized by the present invention, for example, steel or titanium.

To operate the preferred embodiment of the present invention as described in FIGS. 2 through 6, above, as a hydraulic motor, a hydraulic source is connected to line 306 and hydraulic fluid flows through this line, coupling 304, cylindrical conduit 296, fitting 258, line 256, manifold 250, and valve 248 into cylinder 244.

Piston 242 is forced down by the pressurized fluid causing the cylinder assembly of the present invention to rotate. This rotation is imparted through flange assembly 288 to drive shaft 284. Drive shaft 284 can then be coupled to any desired load, e.g., an electric generator, or even to another piece of hydraulic machinery, as will be discussed in connection with FIG. 7, below.

A valve control means capable of opening inlet valve 250 during the downward power stroke of piston 242 and of opening outlet valve 252 during the upward exhaust stroke of piston 242 must be provided for the present invention to operate as a hydraulic motor. The operation of these valves could be hydraulic, mechanical or electrical, but they must be positive action valves not actuated by the internal pressure within cylinder 244. Further, each of the four cylinders of the embodiment shown in FIGS. 1 and 2 of the present invention must be equipped with such valves and the valves must be controlled to open and close at the proper time to deliver hydraulic fluid to the pistons during their downward power stroke and to exhaust hydraulic fluid under virtually zero pressure to a sump during the exhaust stroke.

These valves and their timing means have been omitted from the present invention because they can be made and used by anyone who has ordinary skill in the art of mechanical or hydraulic engineering.

The inventor prefers to use a series of mechanical valves using rockers arms and pushrods very similar to those used in an automobile. In the present case, however, no cam shaft is needed, but rather appropriate cams are constructed on the outer surface of crankshaft block assembly 218.

Exhausted hydraulic fluid flows out of the exhaust valves of the respective cylinders into output manifold 254, thence through exhaust line 274, hemi-cylindrical conduit 302, coupling 298 and line 300.

Motor Example

Referring to the pump example described above, if 100 psia fluid at 3,264 gallons per minute drives the preferred embodiment of the present invention shown in FIG. 2 as a hydraulic motor, then each stroke of each cylinder will utilize 8.16 gallons per stroke when the stroke length is set at 24 inches. Four cylinders would thus use 32.64 gallons per revolution. Thus input of 3,264 gallons per minute would drive the motor at 100 rpm.

If the stroke length is decreased to 6 inches, then each stroke of each cylinder uses 2.04 gallons for a total of 8.16 gallons per revolution of the cylinder assembly. This yields an rpm of 400, necessarily at a torque approximately one-quarter of the torque the present invention yields at 100 rpm.

Again the power carried out of the present invention when it is operating as a hydraulic motor by output shaft 284 will be equal to the incoming hydraulic power, less frictional losses, which should be only on the order of 10%.

The output rpm and torque, however, may be varied, these two variables always being inversely related to each other, within wide limits by varying the mechanical advantage of the system.

Figure 7:
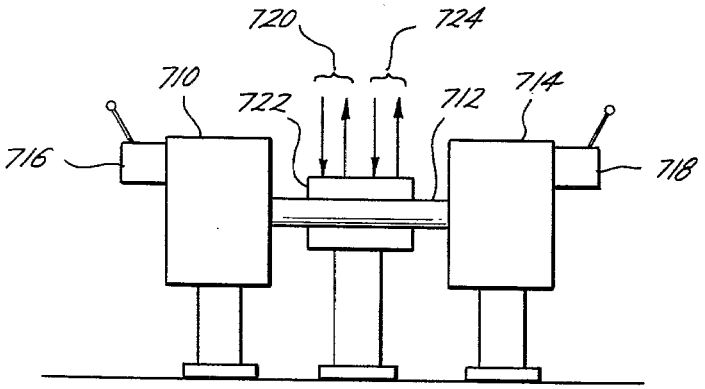
FIG. 7 is a conceptual block diagram illustrating a hydraulic variable transformer constructed using the preferred embodiment of the present invention.

FIG. 7 shows a schematic diagram of two motor/-pumps constructed according to the preferred embodiment of the present invention described above that are mechanically connected together to form a hydraulic variable transformer.

A hydraulic variable transformer is the hydraulic analog of an electrical variable transformer.

An ordinary electric transformer works by introducing a first voltage and current into primary coil windings. This first voltage and current generates an electromagnetic (EM) field. The EM field interacts with secondary coil windings to generate an electric voltage and current. The voltage in the second winding is directly proportional to the voltage introduced into the first coil times the ratio of the number of turns in the secondary coil to the number of turns in the primary coil. The current in the secondary windings is directly related to the current in the primary windings and inversely related to the ratio of the number of turns in the secondary of the transformer to the number of turns in the primary coil.

An electrical variable transformer utilizes a moving tap to change the number of turns in the secondary winding of the transformer thus altering the ratio of the secondary turns to primary turns in the transformer. Again, for a constant voltage and current input, the adjustable nature of the variable transformer allows a greater or lesser voltage to be output from the secondary coil windings, always with the proviso that the current output is inadversely related to the voltage output such that the output power from the secondary, (power being current times voltage) is always equal to the input less power hysteresis losses. Hysteresis losses in an electrical machine are analogous to frictional losses in a hydraulic machine.

The present invention is a highly efficient motor/-pump having a variable mechanical advantage. The efficiency range of the present invention both as a pump and a hydraulic motor can be over 90 percent. Thus, if two units constructed according to the preferred embodiment of the present invention are connected together mechanically such that one acts as a motor driving the other, which acts as a pump, then the resultant device functions as a hydraulic equivalent of the electrical variable transformer.

Specifically with respect to FIG. 7, hydraulic motor 710 constructed according to the preferred embodiment of the present invention is connected by means of shaft 712 to drive pump 714, which is a pump constructed according to the preferred embodiment of the present invention.

Hydraulic motor 710 has a control assembly 716 capable of varying its mechanical efficiency as described above. Pump 714 has a control assembly 718 capable of altering its mechanical advantages as described above. Input-output pair 720 delivers hydraulic fluid from and to hydraulic motor 710 through fluid coupling 722. Input-output pair 724 delivers hydraulic fluid to and from pump 714 through fluid coupling 722.

Functionally, fluid is introduced to hydraulic motor 710 at a given flow rate and pressure through input-output line 720 and hydraulic coupling 722. This hydraulic power supply drives motor 710 at a characteristic rotational speed and torque, which depend on the input flow rate, pressure and the setting of control 716. The rotational output of motor 710 drives pump 714 through drive shaft 712. Pump 714 generates a pressure and flow rate of hydraulic output, said pressure and flow rate depending on the torque and speed of shaft 712 and on the setting of control 718. This hydraulic output exits pump 714 through input-output line 724.

Within design limits dictated by the physical parameters of pump 714 and hydraulic motor 710, it is possible for a given flow rate and pressure of fluid input to the hydraulic motor 710 to produce a wide range of pressures or flow rates from hydraulic pump 714.

Another embodiment of the present invention is a positively driven, infinitely variable hydromechanical transmission. In this embodiment, shaft 712 joining motor 710 and pump 714 is severed and a remote prime mover, not shown, drives hydraulic pump 714. The hydraulic connection to pump 714, i.e., hydraulic lines 724, are connected to hydraulic lines 720, which drive hydraulic motor 710. The portion of shaft 712 associated with hydraulic motor 710 can then be used to drive a remote load, not shown. Functionally, by varying the degree of mechanical advantage in pump 714 and motor 710, a given rotational speed and torque input to pump 714 can produce a very wide range, and more importantly an infinitely variable, positively coupled range, of output speeds and torques from hydraulic motor 710. By saying that the transmission built according to the above description is "positively coupled" is meant that the fluids pumped by pump 714 and used to drive motor 710 is essentially incompressable. Thus any mechanical movement of the fluid caused by pump 714 will result in a corresponding non-slipping mechanical movement in hydraulic motor 710. Infinitely variable hydraulic transmissions are known, but they depend for their effectiveness on the viscosity of a liquid such as the automatic transmission used in most modern cars. They are not positively coupled transmissions.

The only limitations on the system are those dictated by its physical construction, i.e., the size of the pistons, volume of the cylinders, degree of stroke variability permitted by the design of the crankshaft assembly, etc. and the losses caused by fluid and other frictional interactions within pump 714 and hydraulic motor 710. Also, the hydraulic power output of pump 714, regardless of its flow rate or pressure, cannot be greater than the power input to hydraulic motor 710, regardless of its flow rate of pressure, less frictional losses.

By connecting flow sensors and pressure sensors to input-output lines 720 and 724 control units 716 and 718 may be automatically operated by means of negative feedback servo-circuits to obtain a desired output from pump 714 while holding the supply pressure and flow rate to hydraulic motor 710 constant. Alternatively, hydraulic motor 710 could be fed an erratic hydraulic supply, one that varies in pressure and/or flow rate, and the servo-circuit could maintain negative feedback control such that the output of pump 714 would be at a constant flow rate of pressure. The construction of such servo-circuits is well within the state of the art and their use with the present invention would result in a hydraulic equivalent of an electrical auto or "constant voltage" transformer. Such a device, especially one that operates at the high efficiencies allowed by the present invention, could be extremely useful in conditioning erratic hydraulic power surges from wave or wind generators to provide constant output pressure required to drive conventional turbines such as a Pelton wheel turbine.

FIG. 8 shows an embodiment of the present invention used to vary the mechanical advantage of a reciprocating pump system. This system is used to condition power output from a wave generator. The wave generator is similar to the one taught by U.S. Pat. No. 4,077,213.

In FIG. 8 a wave generating facility comprises a fixed point 810 coupled to a first float 812 through a hinge 814. Float 812 is connected through a second hinge 816 to a second float 818. These floats may be rafts approximately 10 feet thick and 50 feet long. Their size varies as described in U.S. Pat. No. 4,077,213 to produce an array capable of absorbing energy from a variety of different wave lengths of ocean waves.

As is shown in FIG. 8A, the sea state (the rafts ride approximately half submerged) causes perturbation of the float 818 with respect to float 812 about hinge 816 of approximately 10 degrees.

A hinged hydraulic cylinder 822 is connected at its rear by hinge 824 to the upper surface of float 812 by bolting, welding or other means. Hydraulic cylinder 822 has a shaft 826 that is attached to support framework 828 at hinge point 830.

Variable height structure 828 is shown in FIG. 8A at a length "l" above the top surface of float 818. Support structure 828 comprises a pair of cylinder bearings 832 that are sized to be capable of carrying the force that is transmitted to them by the movement of float 818 via shaft 826 and thence to hydraulic cylinder 822.

A second hydraulic cylinder 834 has its hydraulic shaft attached to support mechanism 828 and is adapted to controllably raise and lower the mechanism.

FIG. 8B, in which like numbers indicate like structures, shows the wave generator comprised of stationary point 810 and floats 812 and 818 in a sea state where float 818 is perturbed to a maximum deflection of 90 degrees with respect to float 812 about hinge 816. As shown in FIG. 8B, hydraulic cylinder 834 has lifted support structure 828 so shaft 826 moves through a much longer stroke "S" than it did in FIG. 8A.

Functionally, any perturbation of float 818 perturbs attachment point 830 of support structure 828 and shaft 826 to a greater or lesser degree, depending on the elevation of attachment point 830 above the surface of float 818. The height of this attachment point, and thus the mechanical advantage of the system, is variable depending on the degree of extension of hydraulic cylinder 834.

If the sea state is as shown in FIG. 8A, i.e., a small amount of ripple inducing a movement of approximately 10 degrees total about joint 816, then cylinder 834 stays retracted and the 10 degree movement of point 830 causes only a very small movement in shaft 826. Hydraulic cylinder 822 thus pumps only a small amount of fluid.

As wave action increases, the deflection of float 818 with respect to float 812 about joint 816 increases. The present invention teaches the varying of the mechanical advantage used to actuate hydraulic cylinder 822 by increasing the length "l" so as to maintain, preferably, a constant pressure while increasing the flow rate out of the cylinder. Cylinder 822 is a double action hydraulic cylinder and it is desirable to maintain a constant pressure out of it to drive a Pelton wheel turbine, which is essentially a constant pressure device. Clearly a mere change in operating rationale would allow a constant flow rate to be maintained at a variable pressure.

Looking now to FIG. 9, and in conjunction with FIGS. 8A and 8B, it will be noted that FIG. 9 is a table that lists the following quantities from left to right for a wave generator built according to FIG. 8 and U.S. Pat. No. 4,077,213. The table assumes the piston has a one-square meter surface and operates at a constant pressure of 100 kilograms per square centimeter (approximately 1400 pounds). From left to right the columns in FIG. 9 are defined as follows:

Theta equals the number of degrees of total average perturbation per cycle experienced by float 818 with respect to float 812. As such, it also defines the arc of movement described by the top of lifting structure 830 with respect to shaft 826. (Actually this is an approximation, but if the hydraulic cylinder is located near the end of the raft compared to its overall length, then the approximation will be acceptable.)

Stroke "s" is the distance, in centimeters, traveled by shaft 826.

Length "l" is the length, in centimeters, that the top of structure 828, and thus joint 830, is above the surface of float 818.

Average hydraulic power "KWH" is the number of kilowatt hours of hydraulic power generated by cylinder 112 during a single perturbation of float 818.

For a hydraulic cylinder operating at 100 kilograms per square centimeter and having a total piston surface area of 10,000 square centimeters, the minimum stroke of 5 centimeters (about 2 inches) occurs when joint 830 is about 2 feet (57 centimeters) off the deck of float 818. This stroke yields an average hydraulic power output of 0.12 KWH.

For the same system operating under very turbulent sea states, i.e., a maximum perturbation of 90 degrees, float 818 would generate a stroke of 300 centimeters (approximately 10 feet), if the mechanical advantage of the system were varied by lifting attachment point 830, 392 centimeters (about 12.8 feet) off the surface of float 818. This 300 centimeter stroke generates 9.5 KWH.

Another way to state this is that the minimum stroke described above generates a flow of 50 liters of fluid at about 1400 psi while the maximum stroke described above, generates 3000 liters of fluid flow at this pressure. In terms of power, if waves strike the raft assembly so as to perturb the raft through its maximum deflection three times per minute, then a 10 degree average perturbation results in an average power output of 21.6 KW per piston and the maximum perturbation of 90% results in the output of 1,711 megawatts per piston.

If the float array described in connection with U.S. Pat. No. 4,077,213 was equipped with 1000 pistons constructed according to the preferred embodiment of the present invention shown in FIGS. 8A and 8B and this array was operated at 100 kg/cm$^2$ and each piston had one meter of surface area, then at 10 degree perturbation, the system would produce an average of 21 megawatts continuous and at maximum perturbation of 90 degrees, the system would produce 1711 megawatts continuous.

The embodiment of the present invention described in connnection with FIG. 8 above teaches a means for changing the mechanical advantage of a power absorption system on a wave generator such that a one-to-seven length change in the height of support structure 828 causes one-to-sixty power absorption change by cylinder 822.

The preferred embodiment of the present invention operating on a wave generator would have some means of sensing wave height in advance of the wave striking the float array. This means could be an independent sensor riding ahead of the raft assembly or could be an optical sensor. Once the wave height is known, then a computer could calculate the expected deflection of the rafts based on the rafts' known response to different wave heights and a servo-circuit would adjust the height of holding assembly 828, and thus the mechanical advantage of the power extraction system, so double action cylinder 822 would output a constant pressure output.

A system such as the system described above could be placed under computer control to tune a wave generator to the power spectrum of incoming waves.

Figure 10:
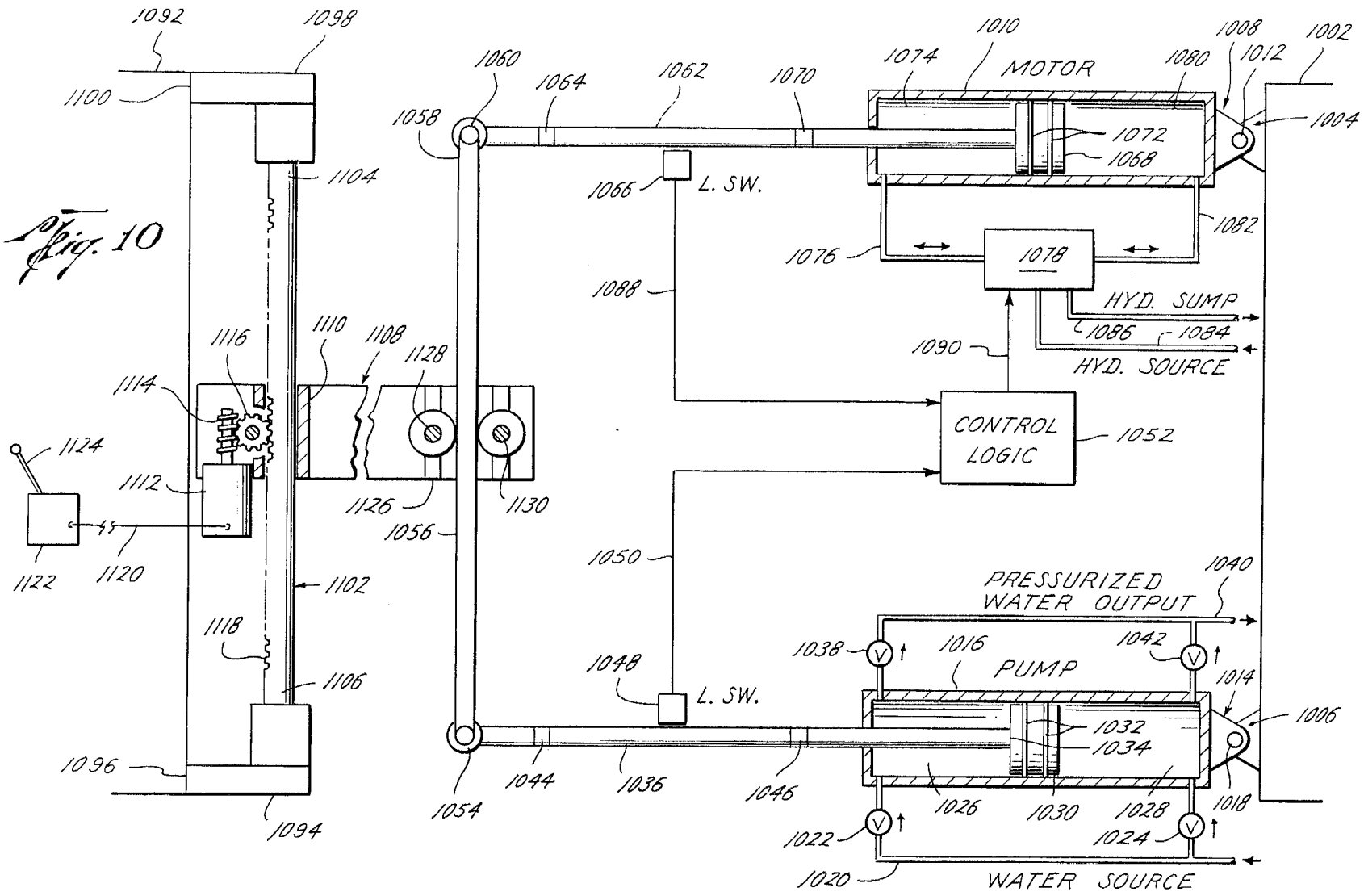
FIG. 10 illustrates a third embodiment of the present invention wherein mechanical advantage is varied on a level arm between two parallel-mounted hydraulic cylinders.

FIG. 10 shows an embodiment of the present invention wherein the mechanical advantage between a hydraulic cylinder acting as a motor and a hydraulic cylinder acting as a pump is varied by changing the fulcrum position of the connecting linkage between the two parallel hydraulic cylinder actuating rods.

Structurally, wall or fixed mounting 1002 is provided with two spaced apart pivotal hydraulic cylinder mountings, i.e., first hydraulic cylinder mounting pivot 1004 and second hydraulic cylinder pivot mount 1006. Pivot flange 1008 on the back of hydraulic cylinder 1010 is connected by means of bearing 1012 to pivot mount 1004.

Hydraulic cylinder swivel flange 1014 of hydraulic cylinder 1016 is connected by means of bearing 1018 to mounting pivot mount 1006.

In the preferred embodiment of the present invention bearings 1012, 1018 are adapted to allow their respective hydraulic cylinders one degree of rotational freedom, i.e., the cylinders are constrained to swing through an arc within the plane of the drawing as shown in FIG. 10.

Water source line 1020 is in fluid communication with the water source, not shown. Line 1020 is also in fluid communication through check valve 1022 with forward portion 1026 of double acting cylinder 1016. Line 1020 is also in fluid communication through check valve 1024 with the rear interior space 1028 of cylinder 1016. A piston 1030 is movably disposed within cylinder 1016. Annular seal rings 1032 place the perimeter of piston 1030 in sealing contact with the interior walls of cylinder 1016. Piston 1030 is connected via central wrist pin 1034 to hydraulic pump shaft 1036.

Forward portion 1026 of hydraulic cylinder 1016 is in fluid communication through check valve 1038 with pressurized water output line 1040. Rear portion 1028 of double acting hydraulic cylinder 1016 is in fluid communication through check valve 1042 with hydraulic output line 1040.

Hydraulic pump actuator shaft 1036 has a forward magnetized portion 1044, which is located at that point on shaft 1036 that will pass under limit switch 1046 when piston 1030 reaches the rear wall of cylinder 1016. Shaft 1036 also has a second magnetized region 1046 located on said shaft so as to pass under limit switch 1048 when piston 1030 reaches the front wall of cylinder 1016. Limit switch 1046, which in the preferred embodiment of the present invention is a magnetic reed switch set close enough to shaft 1036 to be actuated by magnetized regions 1044 and 1046. Magnetic reed switch 1048 is connected by electrical control line 1050 to control logic 1052.

The forward end of actuating rod 1036 is connected via bearing 1054 to end 1055 of transverse rocker arm 1056. The other end 1058 of rocker arm 1056 is connected by bearing 1060 to hydraulic motor arm 1062.

Hydraulic motor arm 1062 is equipped with a forward magnetized region 1064 which is located on shaft 1062 so as to lie under and proximate limit switch 1066 when piston 1068 is proximate the rear wall of cylinder 1010. Shaft 1062 has a second magnetized region 1070 which is located on shaft 1062 so as to be proximate limit switch 1066 when piston 1068 reaches the forward wall of cylinder 1010.

Piston 1068 is movably disposed within cylinder 1010 and its outer perimeter is adapted to carry sealing rings 1072 which place its outer perimeter in sealing contact with the interior wall of cylinder 1010. Forward portion 1074 of the interior of cylinder 1010 is in fluid communication by line 1076 with valve assembly 1078. The rear interior portion 1080 of cylinder 1010 is in fluid communication with valve 1078 through hydraulic line 1082. Valve 1078 is in fluid communication with hydraulic pressure source, not shown, via line 1084. Valve 1078 is in fluid communication via line 1086 with a hydraulic sump, not shown.

Limit switch 1066 is electrically connected via line 1088 to control logic assembly 1052. Control logic assembly 1052 is in electrical command communication with valve 1078 by means of command line 1090.

Control logic 1052 is any logic circuit capable of putting out a change of state command signal to valve 1078 when switch 1048 senses magnetized region 1044 or 1046, or limit switch 1066 senses magnetized region 1064 or 1070. Valve 1078 is any valve that, on reception of a change of state signal from control logic 1052, alters the hydraulic connections of lines 1076 and 1082 to lines 1086 and 1084 so as to reverse the motion of piston 1068 in cylinder 1010.

Mounting surface 1092 has a spaced apart first mount 1094 affixed to it by weld 1096 and second mounting means 1098 spaced apart from 1094 and affixed to it by weld 1100, or any equivalent mounting means. Geared cylindrical bearing surface 1102 is affixed at its upper end 1104 to mounting means 1098 and at its lower end 1106 to mounting means 1094. Movable fulcrum assembly 1108 includes a cylindrical bearing 1110 adapted to slidably engage cylindrical bearing surface 1102. A motor 1112 drives a worm gear 1114. Worm gear 1114 drives idler gear 1116, which engages the geared portion 1118 of bearing surface 1102. Motor 1112 is a reversible electric motor connected by control line 1120 to reversible motor controller 1122, which is actuated by control lever 1124.

Bearing 1110 is attached on its other side by any convenient means to roller bearing variable fulcrum assembly 1126. Within bearing fulcrum assembly 1126 a first roller bearing assembly 1128 is located on the side of rod 1056 near motor 1112 and a second roller bearing 1130 is located within fulcrum assembly 1126 on the side of rod 1056 opposite bearing 1128.

Functionally, a hydraulic source, not shown, is connected in fluid communication through line 1084, valve 1078, and line 1076 to the interior forward portion 1074 of cylinder 1010. Simultaneously a rear portion 1080 of cylinder 1010 is connected through hydraulic line 1082 and valve 1078 to hydraulic sump 1086. The pressure difference between the hydraulic source and the hydraulic sump causes piston 1068 to move toward the rear of cylinder 1010. This movement continues until magnetized portion 1064 on shaft 1062 actuates limit switch 1066.

Upon actuation, limit switch 1066 sends a signal through line 1088 to control logic 1052. Upon receiving this signal, control logic 1052 sends a change of state command through command interface line 1090 to valve 1078.

As shaft 1062 has moved into cylinder 1010, this movement has been transmitted through bearing 1060 and rocker arm 1056 to pump actuator arm 1036. The movement of pump actuator arm 1036 will be in the direction opposite the movement of motor arm 1062, thus piston 1030 will move toward the front of cylinder 1016.

As piston 1030 moves to the front of cylinder 1016, water is drawn into rear space 1028 inside cylinder 1016 through check valve 1024 from line 1020 and the water source, not shown. Simultaneously, water is forced out of the forward portion 1026 of cylinder 1016 through check valve 1038 and into line 1040 to the pressurized water output.

When fulcrum assembly 1108 is approximately in the center of track 1102, and thus in the center of rod 1056, then magnetized region 1046 on shaft 1036 will actuate limit switch 1048 at the same time as magnetized region 1064 actuates limit switch 1066.

It will be clear to those skilled in the art of hydraulic control that the function of magnetized regions 1044, 1046, 1064, and 1070 and limit switches 1066, 1048 are to change the state of motion of the motor piston whenever either the motor piston 1068 or the pump piston 1030 reaches the end of its cylinder. As is clearly shown in FIG. 10, if fulcrum point 1108 is moved toward side 1055 of rod 1056, then limit switch 1066 will act to switch control logic 1052 and valve 1078 because rod 1062 is on the longer end of the lever arm formed by rocker arm 1056 and fulcrum 1108. When the embodiment of the present invention shown in FIG. 10 is in this state, then motor piston 1068, and hence motor shaft 1062, will be moving through a relatively long stroke compared to pump shaft 1036 and pump piston 1030. This will allow relatively low pressure hydraulic fluid to pump relatively high pressure water. Of course the flow rate of hydraulic fluid through motor cylinder 1010 will be inversely proportional to the flow rate of water through pump cylinder 1016.

Once motor piston 1068 reaches its forward limit of travel and limit switch 1066 causes the state of valve 1078 to shift, then space 1080 will be connected through line 1082, valve 1078, and line 1084 to the hydraulic pressure source and space 1074 of cylinder 1010 will be connected to the hydraulic sump. This arrangement will cause piston 1068 to move forward toward the front of cylinder 1010 and, as was described above, fulcrum point 1108 and lever arm 1056, as shown in FIG. 10, will cause pump piston 1030 to move from its forward position toward the rear of cylinder 1016. As piston 1030 moves to the rear of cylinder 1016, water is drawn in through line 1020 and valve 1022 to forward portion 1026 of cylinder 1016. Simultaneously, water is forced out of portion 1028 of cylinder 1016 through valve 1042 and line 1040 to the pressurized water output.

When lever 1124 is pushed forward, motor control 1122 sends a signal through line 1120 to motor 1112 that causes worm gear 1114 to rotate so as to cause idler gear 1116 to rotate in the direction that causes fulcrum assembly 1108 to move up track 1102 so that the fulcrum bearings 1128, 1130 are closer to end 1058 of shaft 1056. This action alters the mechanical advantage of the system described in FIG. 10 by allowing a smaller stroke of motor piston 1068 to act through the lever arm formed between fulcrum 1108 and bearing 1054 so as to cause excursions in pump arm 1036 sufficient to drive the magnetized portion of the arm under the limit switch and thus switch the direction of motor operation. In this configuration a relatively small amount of high pressure fluid flowing through motor cylinder 1010 will drive a larger volume of relatively lower pressure fluid of the pressurized water output of pump cylinder 1016.

Conversely, if lever 1124 is pulled down, then motor control 1122 sends a signal to motor 1112 that causes worm gear 1114 to rotate in the opposite direction, which drives the fulcrum 1108 toward end 1055 of shaft 1056. In this configuration a relatively long stroke on the part of motor piston 1068 drives shaft 1062 to and from its limits. This long movement on the part of shaft 1062 causes a relatively shorter movement of shaft 1036. The result is that a relatively low pressure, high volume flow of hydraulic fluid through motor cylinder 1010 will result in the flow of a relatively smaller amount of higher pressure water out of pump cylinder 1016.

The embodiment of the present invention illustrated by FIG. 10 in the above discussion is relatively simple to build and its mechanical advantage can be altered while it is in operation. It should be noted that the hydraulic motor may be run on hydraulic fluid, which is a good lubricant, and may be desirable for placement on offshore wave generating facilities where a closed loop system is desirable for maintenance and lubrication purposes, while the pump system uses a water source and outputs pressurized water, which may be desirable for use on wave generator systems because a Pelton wheel hydraulic turbine operates well on water and filtered ocean water can be used as an open system, thus avoiding the need for the expense of return piping. This system also avoids the possibility of contaminating the ocean with hydrocarbons on the long hydraulic runs from many cylinders to the central hydraulic turbogenerator on a wave generator facility.

The above-described preferred embodiments of the present invention should not be taken as limiting. They describe only a few of the ways a person skilled in the art of mechanical and hydraulic engineering could make use of the present invention. Therefore, the present invention should be limited only by the following claims and their legal equivalents.

I claim:

1. An apparatus including an expandable chamber device which is capable of being operated as a hydraulic motor or pump attached by a reciprocating connecting rod to a crankshaft which includes an adjustment means to alter the distance between the point at which the connecting rod engages the crankshaft and the center of rotation of the expandable chamber device, said adjustment means comprising at least one screw which threadably, movably, orthogonally engages a portion of said crankshaft, said screw being operably connected to a remote controlled prime mover capable of reversibly rotating said screw in such a manner as to position said crankshaft at a distance between the point at which said crankshaft engages said connecting rod and the center of rotation of the expandable chamber device which said hydraulic motor or pump is operating, the improvement comprising:

said adjustment means including at least one bearing shaft closely, slidably engaging the interior of an opening in a portion of said crankshaft.

2. An apparatus comprising:

a hydraulic motor having a reciprocating motor rod, said motor rod having a limit of travel, a hydraulic pump having a reciprocating pump rod, said pump rod having a limit of travel, a rocker lever arm having two ends, one said end engaging said motor rod and the other said end engaging said pump motor rod, a fulcrum means located functionally adjacent said rocker lever arm between said motor rod end and said pump rod end for forcing motion of said motor rod end of said lever arm to cause movement of said pump rod end of said lever arm, said fulcrum means comprising, a fulcrum bearing surrounding said lever arm; a housing pivotally holding said fulcrum bearing; a linear bearing track closely, slidingly engaging a second linear bearing portion of said housing, said bearing track having a geared portion; and a controllably reversible prime mover attached to said housing, said mover controllably and reversibly actuating rotation of the gear that engages the gear portion of said bearing track, whereby said housing and said fulcrum bearing are controllably moveable along said bearing track, sensing means responsive to the position of said pump rod and said motor rod for sensing when said pump rod or motor rod reaches its limit of travel, and control means responsive to said sensing means for reversing the direction of travel of said motor when said sensing means senses that said motor rod or said pump rod reaches its limit of travel.

3. An apparatus as in claim 2 wherein said geared bearing track is substantially parallel to said lever arm when said reciprocating motor arm is midway between its limits of travel.

* * * * *